United States Patent [19]

Titchenal

[11] Patent Number: 4,685,148

[45] Date of Patent: Aug. 4, 1987

[54] SQUARE ENDED VALVE BAG

[75] Inventor: Oliver R. Titchenal, North Ridgeville, Ohio

[73] Assignee: Basic Packaging Systems, Inc., Avon Lake, Ohio

[21] Appl. No.: 904,666

[22] Filed: Sep. 8, 1986

[51] Int. Cl.[4] ..... B65D 30/20; B65D 30/00

[52] U.S. Cl. ..... 383/37; 383/51; 383/54; 383/100; 383/904; 383/121

[58] Field of Search ..... 383/37, 51, 54, 55, 383/57, 59, 48, 100, 104, 107, 105, 114, 120, 121, 125, 904; 493/3, 205, 213, 11, 196

[56] References Cited

U.S. PATENT DOCUMENTS

| | | | |
|---|---|---|---|
| 2,906,446 | 9/1959 | Williams | 383/51 |
| 3,000,550 | 9/1961 | Charlton | 383/48 |
| 3,022,932 | 2/1962 | Vines | 383/48 |
| 3,318,511 | 5/1967 | Winegard | 383/54 |
| 3,327,925 | 6/1967 | Coker | 383/54 |
| 3,648,922 | 3/1972 | Gebo | 383/51 |
| 4,049,191 | 9/1977 | Stearley | 383/54 |
| 4,391,404 | 7/1983 | Welter | 383/51 |
| 4,453,637 | 6/1984 | Mazur | 383/37 |
| 4,524,459 | 6/1985 | Titchenal | 383/37 |

*Primary Examiner*—Willis Little

*Attorney, Agent, or Firm*—Pearne, Gordon, McCoy & Granger

[57] ABSTRACT

Square ended valve bags are formed from a tube-like band and in a chain with the back wall and top end of each bag partially sealed together to provide bags between the seals. Patches are placed on the top end of the bag and the patches and top ends are provided with displaced openings to provide a valve. Each bag in turn may be filled through the valve located in the top end, the bag expanding forwardly from the back wall by expanding gussets in the top and bottom ends.

12 Claims, 9 Drawing Figures

SQUARE ENDED VALVE BAG

BACKGROUND OF THE INVENTION

1. Field to Which Invention Relates

This invention relates to a chain of square ended valve bags, the method of making and filling the square ended valve bags and to a square ended valve bag included in the chain of square ended valve bags and removable therefrom by separating each successive bag from the chain of bags. More specifically, the invention is directed to a square ended valve bag wherein a patch or overlapped portion on the top end are partially sealed together from each seal side of the bag towards the opposite side of the bag, thereby defining valve means through which the bag may be filled from the top.

2. Description of the Prior Art

In prior bags of the square end type, the mouth of the bag has extended from one side wall to the other side wall. Other square ended bags which are also considered to be valve bags made from a film tube are Elwin David Jones, U.S. Pat. No. 3,548,722; E. D. Jones, U.S. Pat. No. 3,482,762; and John Warndell, U.S. Pat. No. 3,646,856. Jones U.S. Pat. No. 3,548,722 teaches a valve insert and a valve formed with the overlapping edges of film forming the top end of a bag. Jones U.S. Pat. No. 3,482,762 teaches the forming of a valve by constructing one of the gussetted end panels in two portions sealed together with their extremities such that they form a valve. Warndell U.S. Pat. No. 3,646,856 teaches the forming of a valve in the gussetted end by means of a valve patch secured around three sides of a slit in the gusset.

STATEMENT OF THE INVENTION

The present invention relates to a chain of square ended valve bags constructed from one or more elongated bands of sealable flexible film, and to the method of making and filling each individual square ended valve bag as well as to the construction of each individual square ended valve bag.

One of the objects of the invention is to provide a square ended valve bag which is constructed from a sealable flexible film with the corners of the bag and the perimeter of the valve sufficiently strong to withstand tearing of the seal or weld during filling, sealing and using of the bag.

Another object of the present invention is to provide a chain of square ended valve bags constructed from an elongated band of sealable flexible film, wherein each bag has a patch or overlapped portion on the top end and sealed to the top end from each seal side of the bag towards the opposite seal side thereof, and thereby defining a valve means through which the bag may be filled from the top.

A further object of the invention is to provide a chain of square ended valve bags interconnected by an elongated longitudinal portion of the band located along the back walls and top ends of all of the bags and with the seal side of each bag breakably joined to the closest seal side of the next adjacent bag in the chain.

A still further object of the invention is to construct from a single elongated band of sealable flexible film, a chain of square ended valve bags which are resistant to tear during filling thereof with a product, and with each bag in the chain successively being able to assume its square ended form during filling with a product either before or after it is separated from the next adjacent bag in the chain.

Other objects and advantages may be observed from the following description of the invention in conjunction with the several drawings.

DESCRIPTION OF THE PREFERRED EMBODIMENTS

Figure 1:
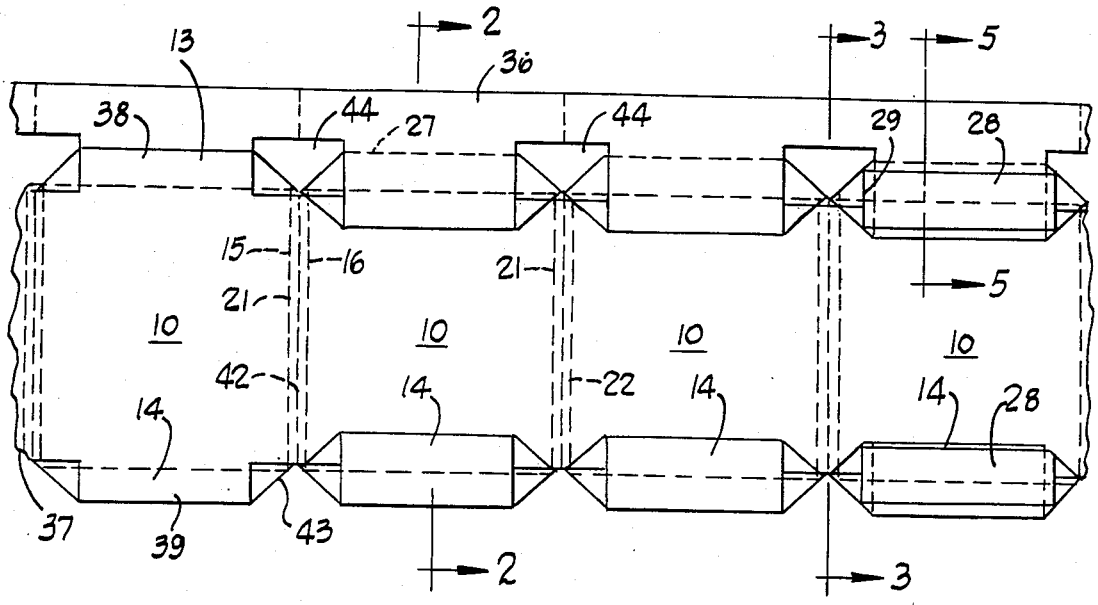
FIG. 1 is a plan view of a chain of square ended valve bags.
Figure 6:
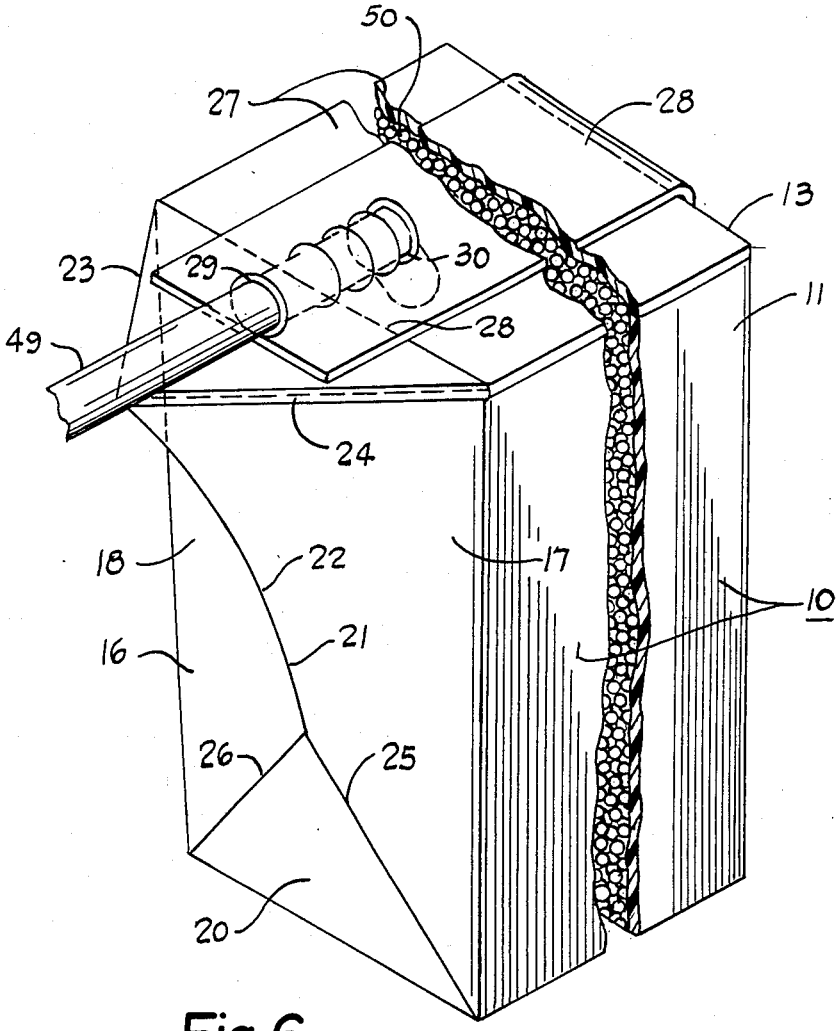
FIG. 6 is a perspective view of a square ended valve bag filled with a product.

FIG. 1 is a plan view showing a chain 35 of square ended valve bags 10, each having a front wall 11, a back wall 12, a top end 13, a bottom end 14, a fore seal side 15, and an aft seal side 16. The fore seal side 15 and aft seal side 16 are substantially identical to each other. As illustrated in FIG. 6, the aft seal side 16 consists of a front wall portion 17, a back wall portion 18, a top end portion 19, and a bottom end portion 20 welded or sealed together by a side seal 21.

Figure 4:
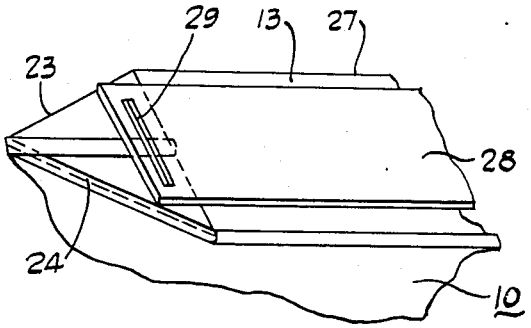
FIG. 4 is a fragmentary perspective view of the top end of the bag.
Figure 5:
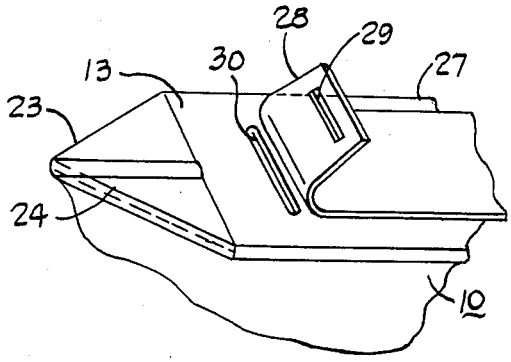
FIG. 5 is a fragmentary perspective view generally along the line 5—5 of FIG. 1 and with the patch partly lifted to illustrate the valve.

As best illustrated in FIGS. 1 and 6, the side seal 21 includes: a center side seal leg 22 interconnecting front wall portion 17 and back wall portion 18 and extending in a plane parallel with the planes of the front wall 11 and back wall 12; a first side seal leg 23 interconnecting back wall portion 18 and top end portion 19 and extending from the terminus of center side seal leg 22 nearest to top end portion 19 to the corner intersection of top end 13 and back wall 12; a second side seal leg 24 interconnecting top end portion 19 and front wall portion 17 and extending from the terminus of center side seal leg 22 at top end portion 19 to the corner intersection of top end 13 and front wall 11; a third side seal leg 25 interconnecting front wall portion 17 and bottom end portion 20 and extending from the terminus of center side seal leg 22 at the bottom end portion 20 the corner intersection of front wall 11 and bottom end 14; and a fourth side seal leg 26 interconnecting back wall portion 18 and bottom end portion 20 and extending from the terminus of center side seal leg 22 at bottom end portion 20 to the corner intersection of bottom end 14 and back wall 12. Because the side seal on the fore seal side 15 is substantially identical to the side seal on the aft seal side 16, the specific legs thereof, and the portions being sealed together are not separately numbered in the drawings. Back wall 12 and top end 13 are sealed together along their juncture by a closing seal 27 generally in a single line in the two planes of back wall 12 and top end 13. In this instance a patch 28 is affixed around its perimeter to the top end 13. The patch 28 has an outer valve opening 29 and top end 13 has an inner valve opening 30 spaced from valve opening 29 as illustrated in FIGS. 4 and 5. The patch 28 also extends onto the top end portions 19 to reinforce the top corners at the ends of the bag. Also this puts a bend in the valve when the bag has been filled so that the valve opening 29 is on the side of the bag and valve opening 30 is on the top of the bag after it has been filled.

Bag 10 is preferably constructed from a single elongated band such as an elongated flexible film of polyethylene, nylon, polypropylene, or other polymerics which can be heat sealed or welded, adhered, cohered or otherwise secured to itself, like materials, or other film materials along the preselected lines by heat sealing, welding, gluing or other adhering means which provide structures having mechanical and property equivalents to each other so as to make side seal 21 and closing seal 27 capable of keeping a product filled square ended valve bag 10 intact during shipment and usage. The band is preferaby in the form of a flattened tube of film, but in some instances may be in the form of a relatively long film folded longitudinally upon itself in flattened tube-like fashion. The band can also be made from multi-ply or laminated films and from films containing fibrous materials such as paper, cloth, and the like which can be secured to itself along seals by hot melt gluing or other adhesives means commonly known in the industry. In addition, the exact dimensions, including thickness of film from which the walls, ends, and sides of a bag are manufactured and the dimensions of the completed bag may be preselected for the specific product and desires of the manufacturer or user of the bag, without departing from the spirit and scope of the invention.

Having thus described a completed, product filled, square ended valve bag as illustrated in FIG. 6, additional details of the method of making a chain 35 of successive bags will now be described. In FIG. 1 there is illustrated a chain 35 of bags, comprising a plurality of bags 10 interconnected by an elongatged longitudinal strip portion 36. FIG. 1 further illustrates schematically the steps in the method of making a plurality of bags 10 from a single elongated band or tube of sealable flexible film 37. Schematically the tube 37 enters FIG. 1 from the left side thereof and finished bags 10 exit from the right. In making the chain of bags, the tube 37 is first provided with a top gusset 38 and a bottom gusset 39. Top end 13 of bag 10 emanates from top gusset 38 and bottom end 14 of bag 10 emanates from bottom gusset 39. Elongated longitudinal strip portion 36 is defined by having the back half 40 of top gusset 38 extend above the front half 41 of top gusset 38. In addition, first side seal leg 23 and second side seal leg 24 may be prevented from merging and sealing or welding together and third seal leg 25 and fourth seal leg 26 may be prevented from sealing together by providing the outer surface of top gusset 38 and bottom gussst 39 with a coating or spacing means which permits welding two adjacent layers of film and prevents all four layers of film in the gusset from welding together. The preventing of the welding of first side seal leg 23 to second side seal leg 24 and third side seal leg 25 to fourth side seal leg 26 while welding side seal legs 23, 24, 25, and 26 is commonly known in the industry and not a part of this invention.

During the making of the bag 10 from tube 37 aft seal side 16 of one bag 10 is breakably connected by a perforated connection 42 to fore seal side 15 of the next adjacent or tailing bag 10, while elongated longitudinal strip portion 36 interconnects the back half 40 of gusset 38 of the two next adjacent bags 10 in the chain 35 of bags. In addition to and extending from perforated connections 42 is a notch 43 cut through bottom gusset 39 and a cut 44 extending through the back half 40 of gusset 38 and also through front half 41 of gusset 38. All cuts 44 and perforations 42 are positioned such that they will be on the outside of each finished bag 10 and so that they will not provide holes in the walls, top ends, or seal sides of bag 10.

In the chain of bags, each bag 10 has its top end 13 and bottom end 14 provided respectively with its top and bottom gusset 38 and 39, and the front wall 11 and back wall 12 are collapsed against each other.

Figure 2:
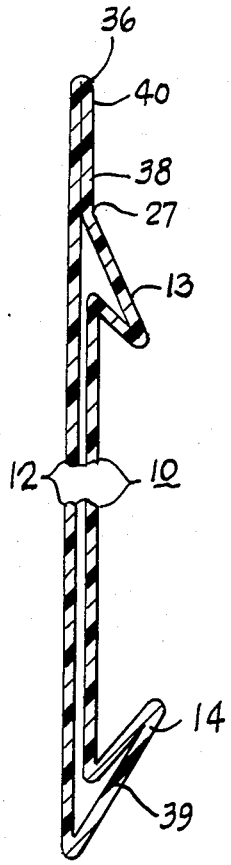
FIG. 2 is a sectional view along the line 2—2 of FIG. 1.
Figure 3:
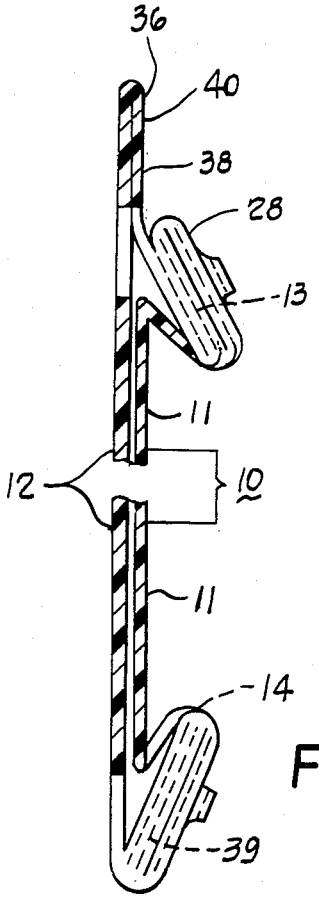
FIG. 3 is a sectional view along the line 3—3 of FIG. 1.

Next, the front half of the top gusset is turned down and the front half of the bottom gusset is turned up, as seen in FIGS. 2 and 3. Inner valve opening 30 is cut in top end 13 in the top gusset and patch 28 with outer valve opening 29 therein is affixed to the top gusset with openings 29 and 30 separated from each other as illustrated in FIGS. 5 and 6. This permits easy insertion of a fill spout 49 to fill product 50 into the bag 10, as shown in FIG. 6. Also, the misalignment of the two valve openings 29 and 30 minimizes leakage of the product from the bag. If desired, the patch 28 may be formed from longitudinal strip portion 36 by cutting this strip portion 36 immediately above the closing seal 27 and affixing same around its perimeter to the top end 13 or from a separate strip of material. When the band 37 is a closed tube, then strip portion 36 becomes a tunnel, interconnecting the chain of bags. A patch 28 may optionally be added to the bottom end 14 of the bag, without a valve, to reinforce the bottom and bottom edges, as shown in FIG. 1.

Figure 7:
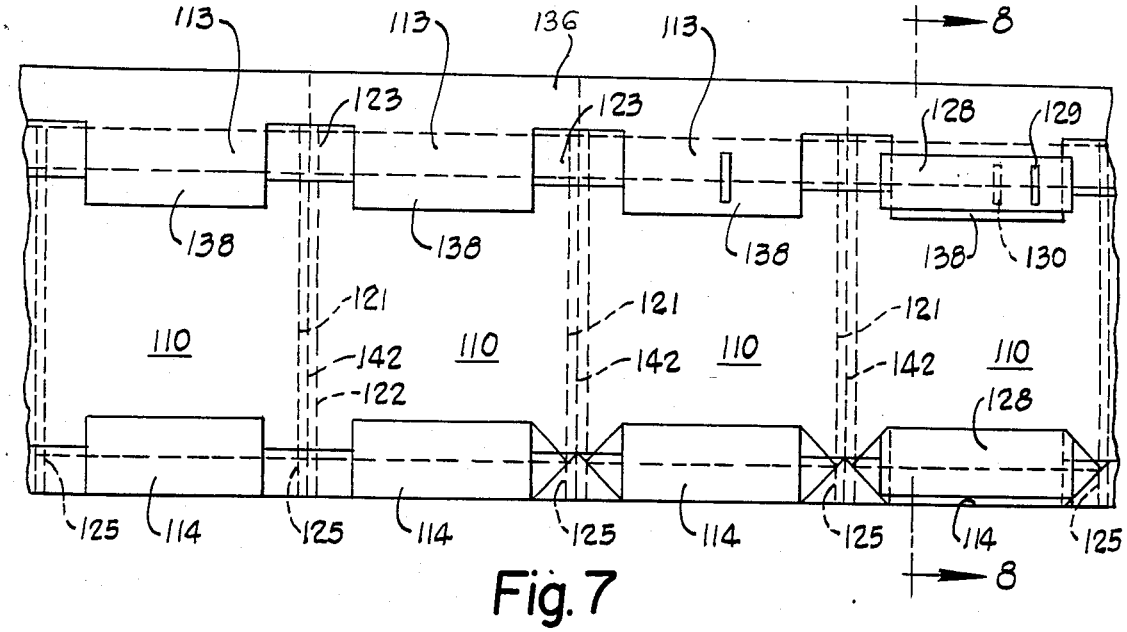
FIG. 7 is a plan view of a chain of square ended bags of modified construction.
Figure 8:
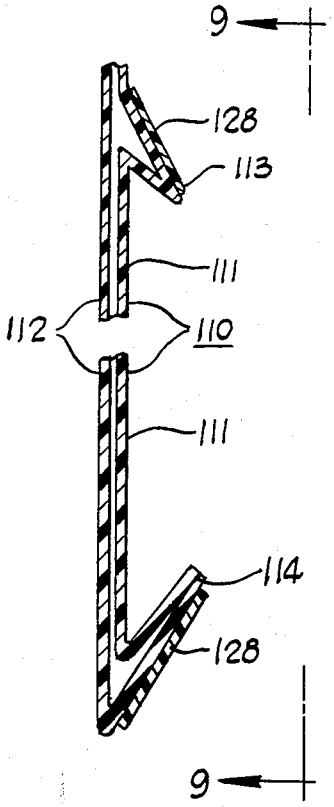
FIG. 8 is a sectional view along the line 8—8 of FIG. 7.
Figure 9:
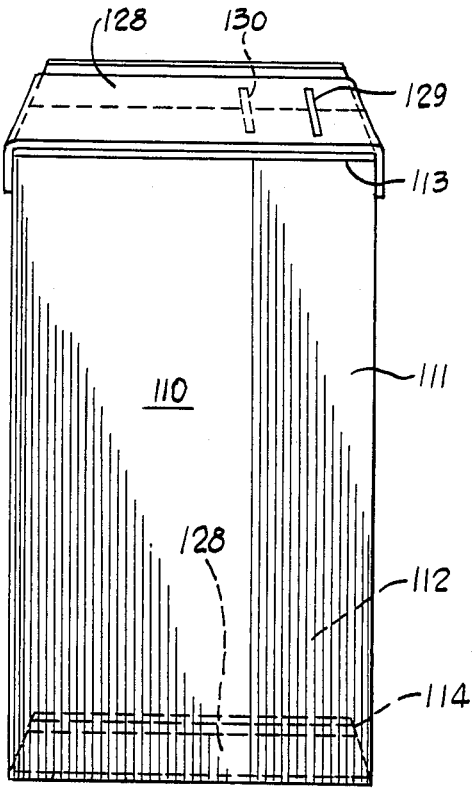
FIG. 9 is a view of a bag from the chain of bags of FIG. 7 after it has been filled.

In modification of FIGS. 7, 8, and 9, a bag 110 is shown, wherein side seal 121 welds all four sides of the top gusset 138 together and all four sides of the bottom gusset 139 together. This forms a unique bag 110 which has v-shaped pockets, one at each end of each side of the bag when the bag has been product filled and sealed. Thus a single side seal 121 has a top gusset welding leg 123 which welds the back wall 112 to the back half of the top end 113 to the front half of the top end 113 to the front wall 111, a bottom gusset welding leg 125 which welds the back wall 112 to the back half of the bottom end 114 to the front half of the bottom end to the front wall, and a center side seal leg 122 which welds only the back wall to the front wall. The center side seal leg 122 thus welds two plies of film while the top and bottom side seal legs 123 and 125 weld four plies of film. The patch 128 covers the v-shaped pockets and thus reinforces the bag corners. In this instance, the outer 129 and inner 130 valve openings are positioned between the side walls of the bag. Other reference numerals shown in FIGS. 7–9 are one hundred units larger than numerals for similar parts in FIGS. 1–6. As in the preferred embodiment the patch may be made from the top longitudinal strip portion 136, or from a separate sheet of material.

Although this invention has been described in preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. In a chain of square ended bags constructed from an elongated band with each of said bags being defined by front and back walls, top and bottom ends, and fore and aft seal sides with each said seal side consisting of portions of said band extending from each said wall and end and sealed together by a side seal, each said seal side being breakably joined to the nearest seal side of the next adjacent bag in the chain, and elongated longitudinal strip means of said band located along the back walls and the top ends of all the bags and at least partially aligning the respective back wall and top end of each bag, the provision of each said bag having its back wall and top end sealed together with a closing seal leg extending from each seal side to the opposite seal side, a patch on said top end affixed around its perimeter to said top end, said patch and said top end having displaced valve openings therein defining a valve means through which the bag may be filled from the top.

2. The chain of bags of claim 1, wherein said ends are gusseted and said walls are collapsed against each other and said patch overlaps the seal sides of the bag at each end of the top end thereof.

3. The structure of claim 2, wherein the outer one of said valve openings is on a seal side of the bag and the inner of said valve openings is in the top end of said bag.

4. The structure of claim 2, wherein both valve openings are on the top end of the bag.

5. The chain of bags of claim 1, wherein the said band is a tube of sealable flexible film and said elongated longitudinal strip means interconnects the back walls and top ends of the chain of bags.

6. The method of making a chain of square ended valve bags each having front and back walls, gusseted top and bottom ends and fore and aft seal sides from an elongated band, said method comprising the steps of:

(a) providing the band with overlying front and back walls and with longitudinal top and bottom gussets, the front and back sides of the bottom gusset being of substantially equal dimension and the back side of the top gusset being of greater dimension than the front side, and said front side of the top gusset being of a dimension equal to the dimension of either side of the bottom gusset;

(b) forming continuous side seal legs of equal length at least part way across each of the gussets and across the band between the gussets;

(c) forming closing seal legs in the back side of the top gusset and longitudinally of the band from the ends of the side seal legs and extending along the length of the back wall of the bag also in a longitudinally elongated portion of the band in the back side of the top gusset;

(d) cutting an inner valve opening in the gusseted top end between said seal sides;

(e) affixing a patch to said top end and about the perimeter of the patch, and providing said patch with another valve opening displaced from said inner valve opening; and (f) repeating steps b, c, d, and e at a longitudinally spaced portion of the elongated band.

7. The method of claim 6 including:

(a) slitting the band longitudinally along the top thereof and affixing the same around its perimeter to the said top end to constitute said patch.

8. The method of claim 6, including forming perforations across said band between adjacent bags to aid in separating a bag from an adjacent bag in the chain.

9. The method of claim 6, including starting with said band in the form of a tube, and forming a continuous tunnel in said back side of the top gusset of said chain of bags by said closing seal legs.

10. The method of claim 6, including forming the inner valve opening in the top end of the bag and forming the outer valve opening in the patch at a seal side of the bag.

11. The method of claim 6, including forming both valve openings to be at the top end of the bag.

12. The structure of claim 5, wherein said closing seal leg forms a tunnel in said longitudinal strip means interconnecting the chain of bags.

* * * * *